US005102140A

United States Patent [19]

Vincent

[11] Patent Number: 5,102,140

[45] Date of Patent: Apr. 7, 1992

[54] AUTOMATED HOLE-IN-ONE RECORDING SYSTEM

[76] Inventor: Gene Vincent, P.O. Box 285, Rock Island, Wash. 98850-0285

[21] Appl. No.: 645,424

[22] Filed: Jan. 24, 1991

[51] Int. Cl.[5] ..... A63B 69/36

[52] U.S. Cl. ..... 273/176 A; 273/35 B; 273/176 L; 273/178 B; 273/34 R

[58] Field of Search .... 273/176 A, 176 AA, 176 AB, 273/176 B, 176 F, 176 FA, 176 FB, 176 J, 176 K, 178 B, 179 R, 35 B

[56] References Cited

U.S. PATENT DOCUMENTS

| | | | |
|---|---|---|---|
| 3,559,996 | 2/1971 | Hopp | 273/176 |
| 3,820,133 | 6/1974 | Adorney et al. | 354/60 |
| 4,192,510 | 3/1980 | Miller | 273/176 A |
| 4,204,683 | 5/1980 | Filippini et al. | 273/371 |
| 4,283,056 | 8/1981 | Miller | 273/176 A |
| 4,296,725 | 10/1981 | Broderick | 124/24 R |
| 4,572,512 | 2/1986 | Tegart | 273/176 A |
| 4,696,474 | 9/1987 | Tegart | 273/176 A |
| 4,713,686 | 12/1987 | Ozaki et al. | 358/107 |
| 4,846,478 | 7/1989 | Saint-Cricq | 273/176 A |
| 4,934,705 | 6/1990 | Shirley | 273/176 R |

FOREIGN PATENT DOCUMENTS

| | | | |
|---|---|---|---|
| 2119261 | 11/1983 | United Kingdom | 273/35 B |
| 2169211 | 7/1986 | United Kingdom | 273/35 B |

*Primary Examiner*—George J. Marlo
*Attorney, Agent, or Firm*—Wells, St. John & Roberts

[57] ABSTRACT

A system for recording the occurrence of a hole-in-one or other preselected event at a golf layout includes a video camera trained upon the tee, the target putting green, and any intervening area between the tee and putting green, plus a recording device for storing video images showing the flight trajectory of a golf ball from a tee to the green. The video camera and recording device are operated by a coin control adjacent to the tee. A golfer first inserts the appropriate coins, causing the video camera and recording device to be operational for a predetermined time period. If a hole-in-one or other specified event occurs, the recorded video images can be monitored to verify this fact and to substantiate the claim of a player to any outstanding offer of a prize or reward.

17 Claims, 4 Drawing Sheets

AUTOMATED HOLE-IN-ONE RECORDING SYSTEM

TECHNICAL FIELD

This disclosure relates to a system for automatically recording the occurrence of a hole-in-one at a conventional or specialized golf layout.

BACKGROUND OF THE INVENTION

One of the most rare occurrences in the game of golf is a "hole-in-one". This is the title applied to the score (one stroke) resulting from reaching the hole on a direct drive from the tee. The resulting number of strokes for the hole is "one", hence the term "hole-in-one".

Few golfers experience the occurrence of a hole-in-one. When this event does happen, the golfer playing the shot often would desire a record of it to convince skeptical friends and to assist in collecting any outstanding wagers, etc.

The present invention was developed to provide an automated record of the occurrence of a hole-in-one. The automated system is coin-operated, which lends itself to the collection of money from those attempting to shoot a hole-in-one. Automated coin collection also makes available a "pool" of money from which to pay prize money to those who succeed in achieving this elusive goal.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The present invention pertains to an automated golf layout and method for recording the occurrence of a hole-in-one at a specified golf hole. The main purpose of this apparatus and method is to facilitate the conduct of a prize contest whereby persons shooting a hole-in-one at a specified hole can be monetarily rewarded when this event does occur. The disclosed system records all activity that happened on the golf layout during a selected shot. This activity can be visually reviewed and verified prior to paying any reward or prize to a golfer. It allows prize games to be operated without live manual surveillance.

The game process utilizes a typical golf layout, which might be an actual hole on a conventional course, a dedicated hole on a conventional course, or a specially-designed dedicated arrangement similar to a driving range. In any event, the golf layout will include a putting green having an open hole recessed therein and a tee spaced from the green.

The golf layout also includes a television camera focused on the tee, the putting green, any intervening area between the tee and putting green, and the normal flight trajectory of a golf ball being as it flies from the tee to the putting green. In other words, the television camera must have a depth of field to maintain the ball in reasonable focus from the time it is struck on the tee until it comes to rest on the green or, in the event of a hole-in-one, until the ball drops into the open hole. The field of view of the camera must encompass the entire golf layout in order to record all activities of the golfer and any other persons in the area of play. The layout also includes a recorder for video images provided by the television camera and a coin-operated controller from the video camera and recording means.

The game process involves inserting one or more coins into the coin-operated controller to activate the video camera and recorder during a predetermined time period, playing a golf ball from the tee during the predetermined time period, and monitoring the video images stored by the recording means to verify the occurrence of any resulting hole-in-one.

Coin-operated controls are typically used to permit public operation of equipment without manual intervention by those owning or maintaining it. The use of the terms "coin-operated" control means or controller is to be understood as encompassing any device that is mechanically or electronically actuated on receipt of a specified monetary unit, which can be either one or more coins, paper bills, arbitrary tokens, magnetically-recorded information or other forms of identifiable control. Such coin-operated controllers are conventional and widely used in dispensing machines and automated game. No further disclosure with respect to these devices is believed to be necessary for an understanding of the present invention.

Figure 1:
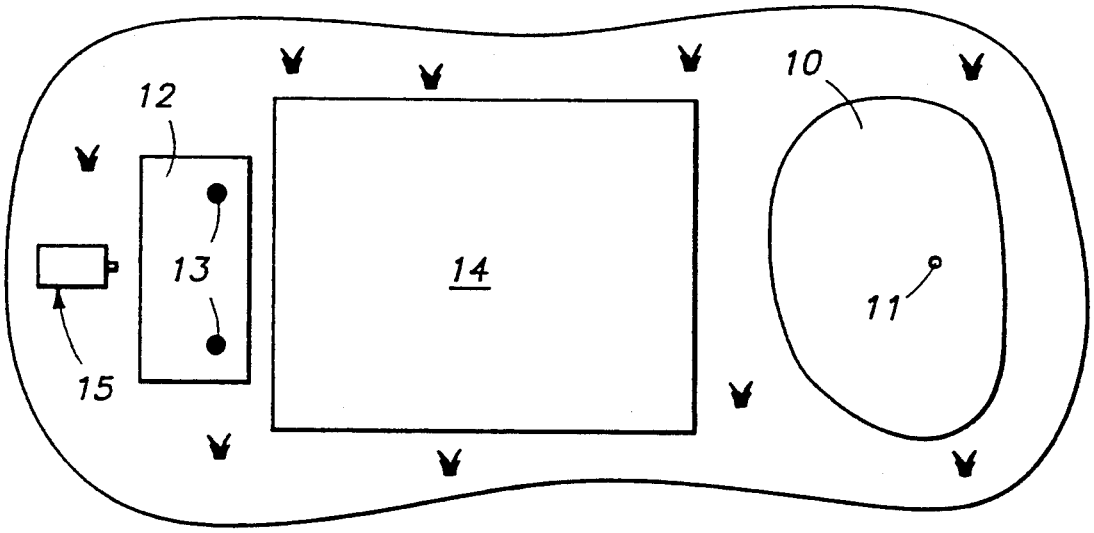
FIG. 1 is a plan view of a first embodiment of the golf layout.

In the first embodiment of the invention (shown in FIG. 1), the golf layout includes a putting green 10 including having an open target hole 11. FIG. 1 generally illustrates the open hole 11 which is the target for the golfer and intended golf ball receiver for any hole-in-one shot on the golf layout. As is conventional on most putting greens, the open hole 11 will normally include an interior metal cup (not shown) that seats a removable flagstick and flag or pennant (not shown) denoting the location of the hole.

A tee 12 is spaced from the putting green 10. It can be provided with one or more pairs of tee markers 13 as conventionally used to indicate the locations about the tee where golf balls are to be put into play.

Putting green 10 and tee 12 are separated by a fairway 14.

The nature and condition of putting green 10, tee 12 and fairway 14 are unchanged from a normal golf course, and no further details concerning their conditions and maintenance are believed to be necessary herein.

The only modification to the usual golf layout as shown in FIG. 1 is the provision of an upright stationary tee enclosure 15. Enclosure 15 is schematically illustrated in FIG. 1 and is more specifically detailed in FIG. 2.

Located within tee enclosure 15 is a video camera 17. Its field of view should include tee 12, putting green 10, fairway 14, any other intervening area between tee 12 and putting green 10, and the normal flight trajectory of a golf ball as it is played from tee 12 to putting green 10. The normal flight trajectory of the golf ball will encompass a predetermined height extending above the golf layoff. The depth of field provided by the video camera 17 should be such as to maintain a golf ball in focus throughout its flight. The wide field of view will permit those later monitoring the recorded video images to identify any interruptions in the flight of a golf ball or substitutions of a golf ball that might have occurred between the tee 12 and putting green 10.

Figure 2:
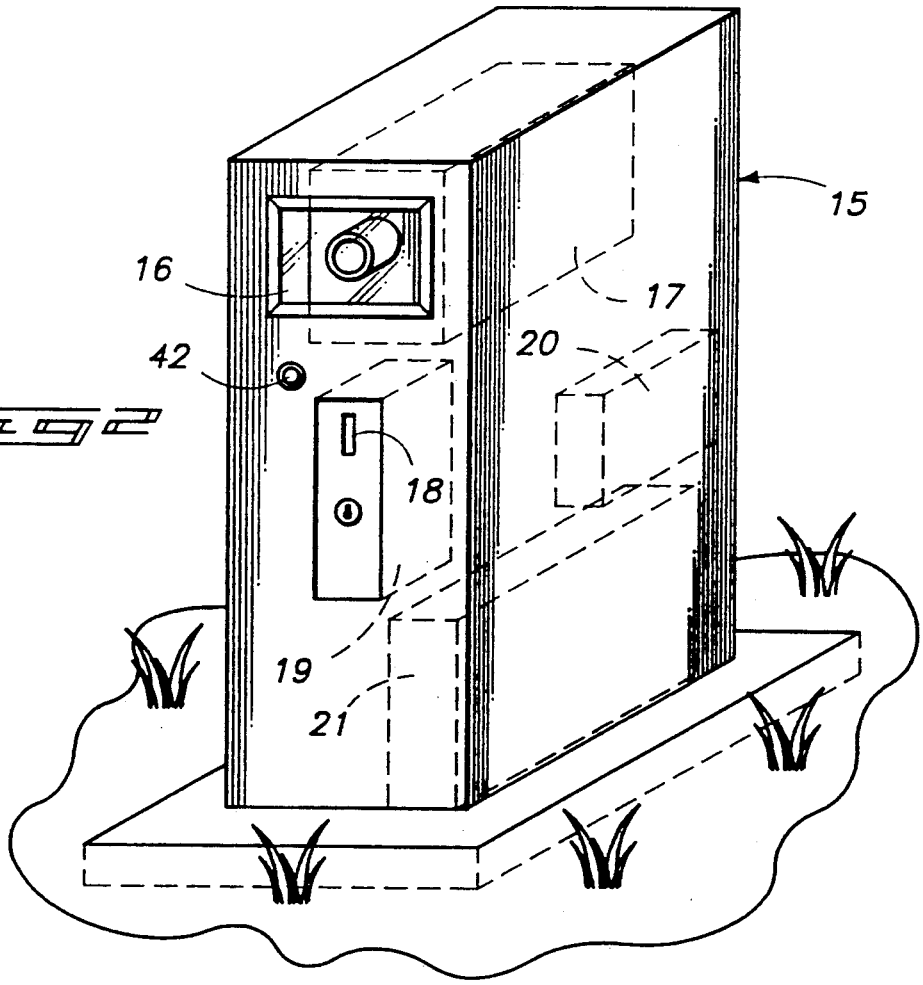
FIG. 2 is a perspective view of the tee enclosure illustrated in FIG. 1.

As shown in FIG. 2, enclosure 15 can be in the form of an above-ground rectangular box sealed about its exterior for weatherproofing and to prevent tampering. One wall of the box is provided with a security window 16 through which the video camera 17 is trained. The exterior of enclosure 15 also includes a coin slot 18 leading to a coin receptacle and control unit 19.

In this fully self-contained recording enclosure, there also can be provided a recorder unit 21, such as a conventional videocassette recorder (VCR). The video camera and VCR can be electronically operated by a common controller 20, which in turn is actuated by the coin receptacle and control unit 19.

The video camera 17, VCR 21 and the coin receptacle and control unit 19 are each conventional in themselves. The only modifications required are that the video camera 17 and VCR 21 must be started and stopped by electrical signals provided by control unit 19 in response to receipt of a specified coin value within the coin receptacle and control unit 19. The design of such controls is well known and within the skill of those familiar with automated and remote operation of a video camera and VCR.

The above-described apparatus lends itself particularly to a specialized game process, using normal golf equipment. The game process to provide rewards for hitting a hole-in-one can be carried out on a conventional golf course without detracting from its usual operation. It might also be used to record other events, such as contests to determine the longest drive that occurs at a hole, the shot closest to the pin of hole on the green, etc.

The normal time period during which the video camera 17 and VCR 21 will be actuated after receiving the specified coin value at coin receptacle and control unit 19 will be approximately 30 seconds. This provides sufficient time for a golfer to return to the tee, address a golf ball, and hit the golf ball onto the green 10. If a hole-in-one or other specified event should occur, the golfer can then claim the prize. The parties operating the facilities can verify the occurrence of the event by monitoring the resulting video images stored in VCR 21.

FIGS. 3–6 show details of a second embodiment of the invention, again utilizing the same golf layoff illustrated in FIG. 1. Similar numbers are used in FIG. 3 to designate putting green 10, tee 12 and fairway 14.

Figure 3:
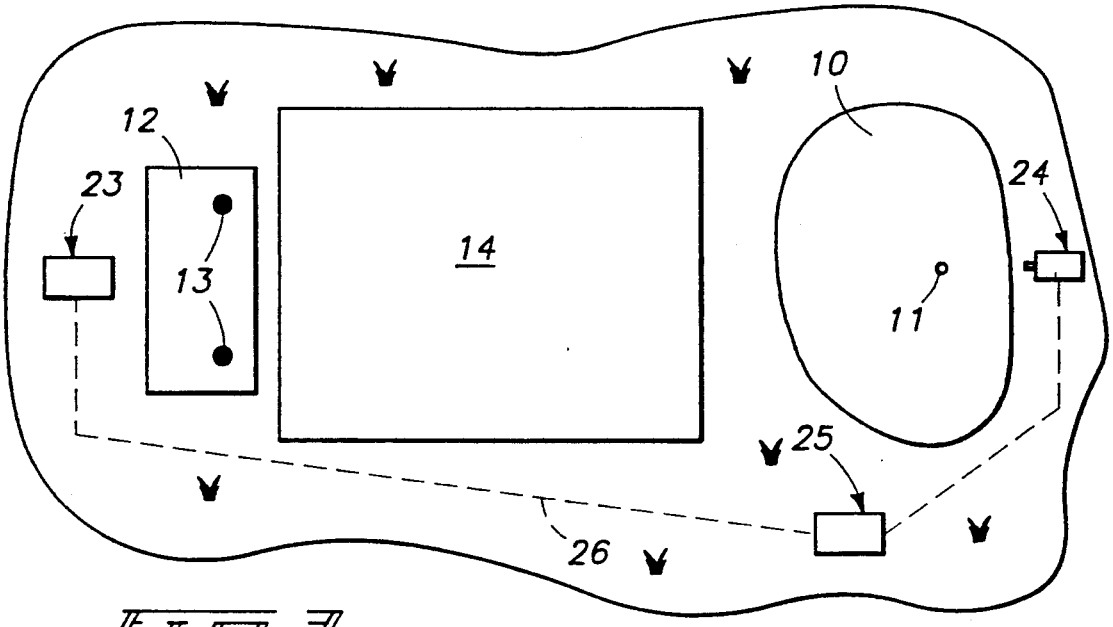
FIG. 3 is a plan view of a second embodiment of the golf layout.

Referring to FIG. 3, the components contained within the previously-described tee enclosure 15 (FIG. 1) are distributed among three separate enclosures located on or adjacent to the golf layout. These include a tee enclosure 23, a green enclosure 24 and a remote enclosure 25.

In this arrangement the tee enclosure 23 houses the coin-operated controls. Green enclosure 24 houses the video camera. Remote enclosure 24 houses the VCR. The three enclosure are interconnected by power and control lines generally designated by the dashed line 26 in FIG. 3. Lines 26 can either be below-ground or above-ground.

Like the tee enclosure 15 shown in FIG. 1, tee enclosure 23 is positioned behind the tee 12. However, since it does not house a video camera, it can be positioned at any convenient location adjacent to the tee. Green enclosure 24 is positioned beyond the putting green 10. Remote enclosure 25 can be located at any location conveniently adjacent to the golf layout. For instance, in a normal golf course, it might be located within the clubhouse.

Figure 5:
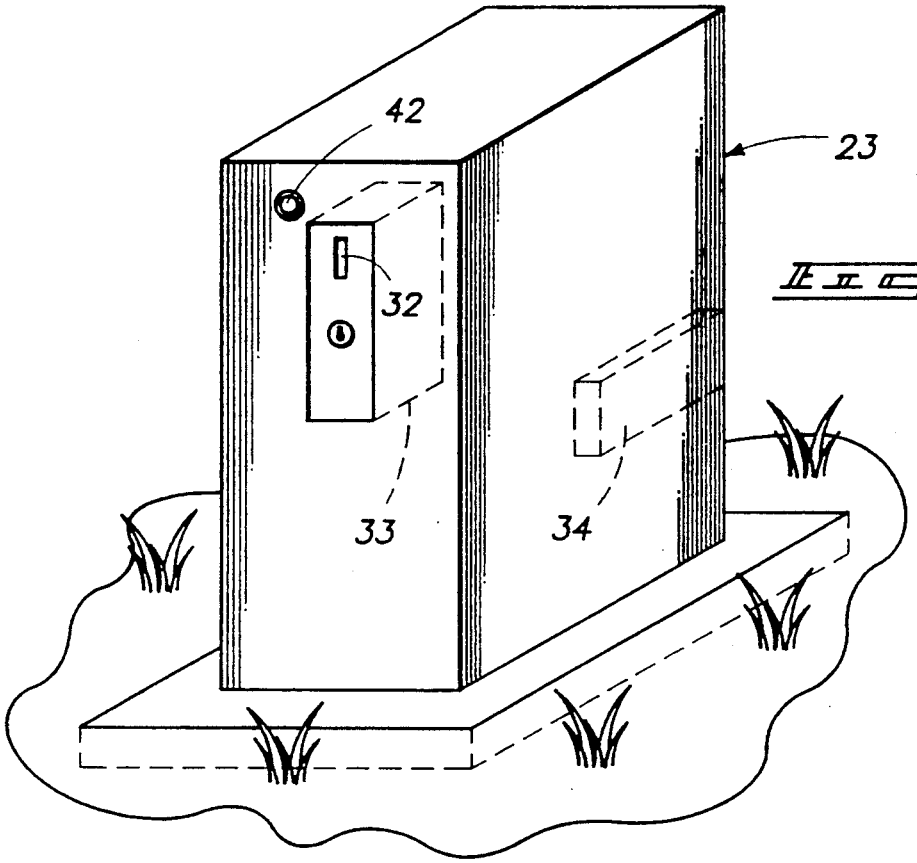
FIG. 5 is a perspective view of the tee enclosure shown in FIG. 3.
Figure 6:
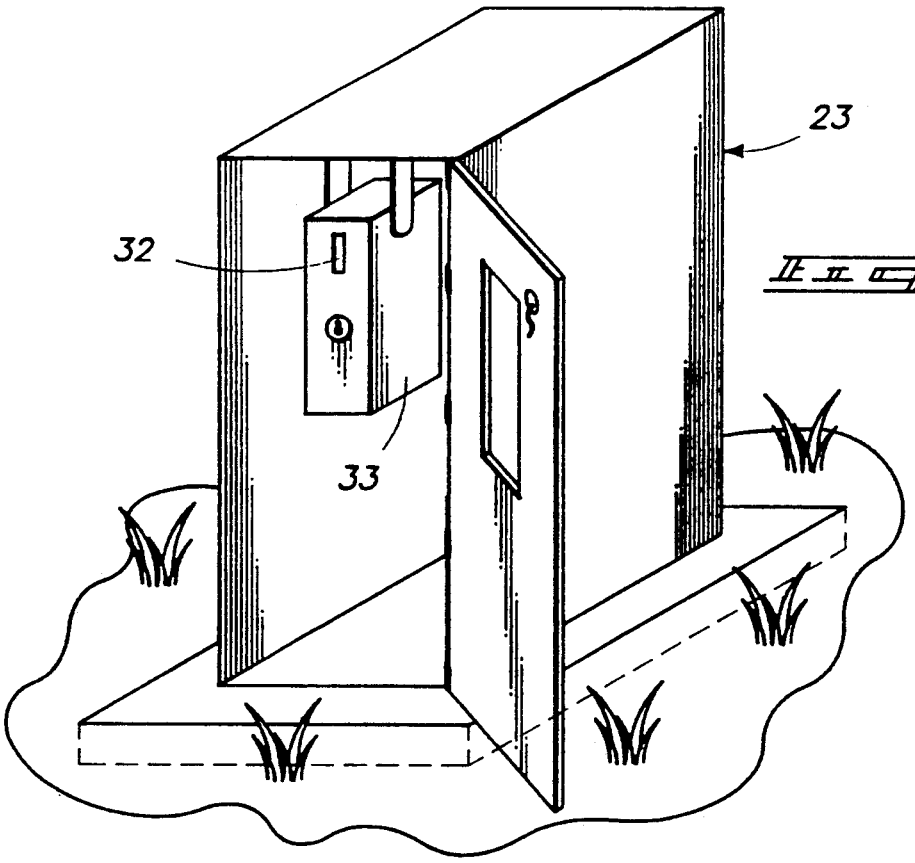
FIG. 6 is a perspective view of the enclosure shown in FIG. 5, illustrating its open condition.

General details of the enclosure 23 are shown in FIGS. 5 and 6. It is an upright enclosure seated on a supporting concrete pad or other foundation. One outside wall is provided with a coin slot 32 leading to a coin receptacle and control unit 33 within enclosure 23. An electronic controller 34 is operably connected to the unit 33 for actuation upon receiving a predetermined monetary value through the coin slot 32.

Figure 4:
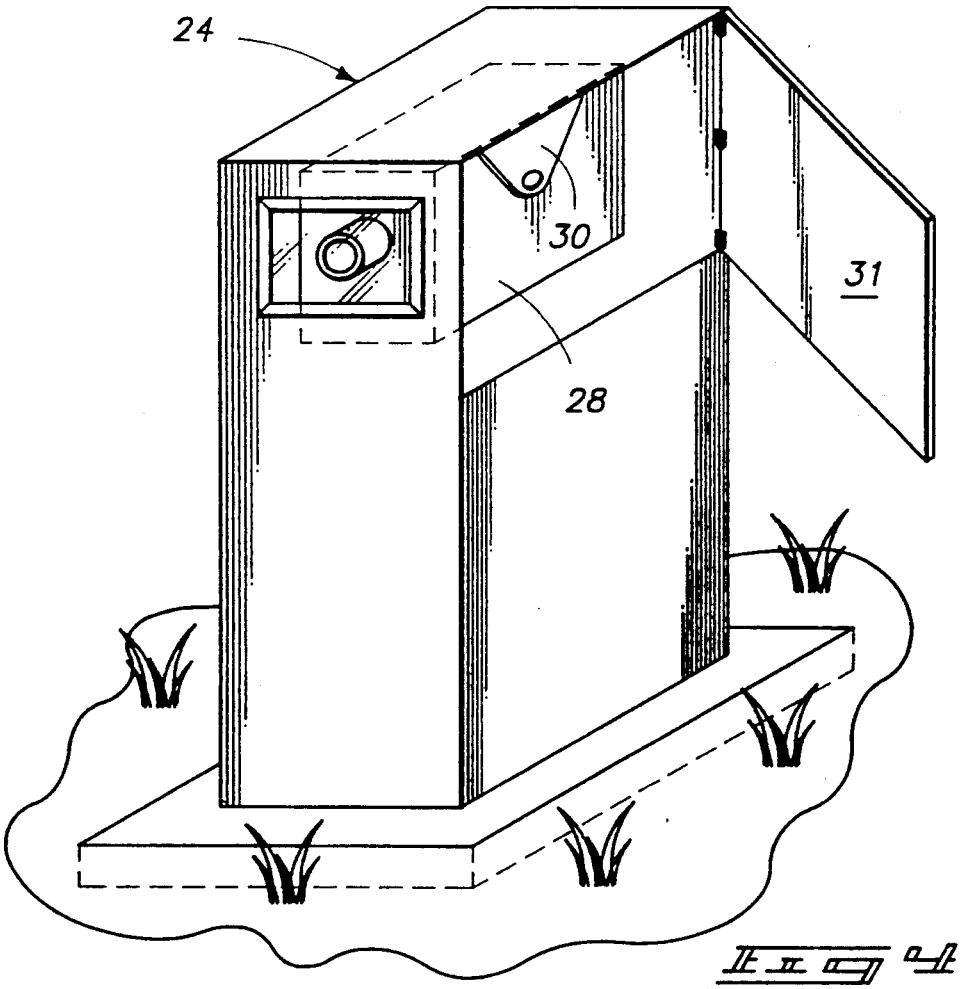
FIG. 4 is a perspective view of the green enclosure shown in FIG. 3.

Green enclosure 24 is generally illustrated in FIG. 4. Its exterior walls include a hinged door 31 for access to a conventional video camera 28 mounted on a swivel mount 30 to assist in aiming the it along the monitored golf layout.

The remote enclosure 25 can either be located outdoors or indoors. When the VCR is indoors, enclosure 25 might be eliminated altogether. A secure room might be used to house the VCR used for recording video images while camera 28 is operational.

To record the occurrence of a hole-in-one or other event at the golf layout shown in either embodiment of the invention, one must first focus the fixed video camera on the tee 12, putting green 10, any intervening area such as fairway 14, and the normal flight trajectory of a golf ball when played from the tee to the putting green. This can be accomplished by using a wide angle lens having a suitable field of view and adequate depth of field to encompass the entire path of a golf ball.

The video camera 28 is operated during a predetermined time period after receipt of a specified coin value within the coin-operated receptacle and control unit 33. After initiating operation of the video camera, the golfer must then play a golf ball to the tee 12. The VCR 21 will automatically record all video images transmitted to it by the video camera while it is operational, thereby storing video images showing the golf layout and flight of a golf ball directed from the tee to the putting green. The concluding step of the present game method required visual monitoring of the recorded video images to verify the occurrence of a resulting hole-in-one other specified event.

The above apparatus and method can be applied to any conventional golf layout on a conventional golf course. Because it is designed specifically for recording a hole-in-one, its application will normally be limited to par-3 holes averaging 125 to 200 yards in length. In addition, the apparatus and method lend themselves readily to applications on driving ranges and dedicated golf layouts for hole-in-one or other specialized golf driving contests. In such situations, a plurality of golf layouts similar to that shown in FIGS. 1 and 2 might be arranged side by side.

Where a plurality of golf layouts are utilized adjacent to one another, multiple video cameras can be operably connected to a single recording VCR, using split image techniques to record the images from the individual cameras when they are operational.

The essential components of the combination are a video camera, a recording device for video images, and a coin-operated control adjacent to the tee for automated recording of the golf ball flight from the tee to the putting green during a predetermined time period.

The recording means for the stored video images is described as a conventional videocassette recorder or VCR. However, it is to be understood that any video storage device might be utilized in place of this specific apparatus, including, but not limited to, optical disks and other permanent or semi-permanent electronic memory media. Similarly, while a video camera is specifically described, it is to be understood that motion picture cameras and alternative electronic image recording devices can be substituted in place of the conventional video camera. The video camera itself might include a recording device or VCR, eliminating the need for a separate component in the illustrated combination.

Because the present system is expected to generate a high volume of play and will result in large numbers of golf balls being left about the surface of the putting green 10, it will be desirable in many applications to provide an automated sweeping device for periodically removing golf balls from an area of the green adjacent to its recessed hole. One example of such a device is shown in FIGS. 7 and 8.

Figure 7:
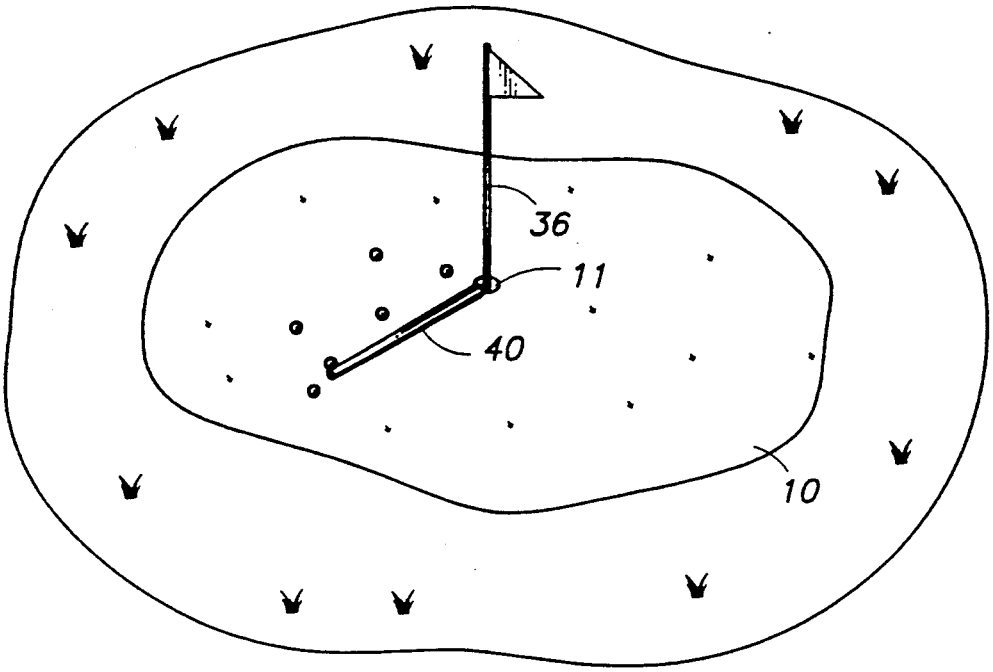
FIG. 7 is a perspective view of a green having an automated sweeping apparatus.
Figure 8:
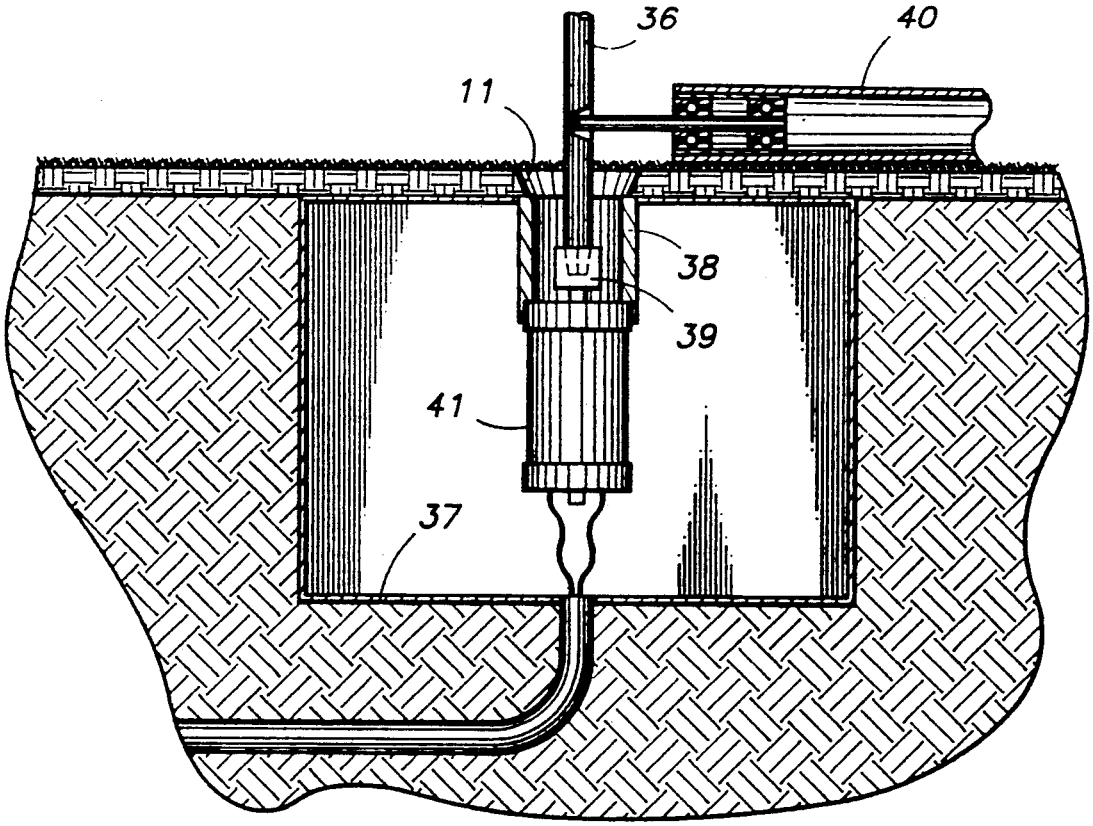
FIG. 8 is an enlarged vertical sectional view through the open hole and cup shown in FIG. 7.

In FIGS. 7 and 8, a modified flagstick 36 mounts the sweeping apparatus for removing golf balls from an area of the green. A motor is operably connected to the flagstick 36 for selectively rotating it about its central vertical flagstick axis. The assembly is completed by an extended horizontal roller 40 having a central roller axis.

The axis of flagstick 36 is vertical. The axis of roller 40 is substantially horizontal. Roller 40 is illustrated as radially projecting outward from the flagstick 36. One roller end is connected to the flagstick 36 for rotating roller 40 about the flagstick axis in unison with rotation of the flagstick 36. During such rotation about the axis of flagstick 36, roller 40 can freely roll about the surface of the putting green adjacent to the open hole. As the roller 40 engages golf balls, they will roll radially outward from the flagstick 36 to clear an area about the open hole 11. The radius of the cleared area will be equal to the length of roller 40.

To facilitate the sweeping nature of roller 40, it should have a progressively reduced diameter tapering outward from the flagstick along the roller axis. Its inner end will be larger in diameter than its outer end. This taper will further propel the rolling golf balls radially outward from the flagstick 36.

Because of its circular motion about flagstick 36, the tapered roller 40 will not be subjected to pure rolling motion about the surface of green 10. Parts of the roller will slip relative to the green surface. This will present no significant problem, since the surface of a golf green is very closely clipped and has relatively low frictional resistance to the rolling action of the roller surfaces engaging it.

General details of the sweeping apparatus are illustrated in FIG. 8. Its drive assembly is sealed within an underground enclosure 37 having a cylindrical cup 38 formed about a vertical cup axis at the top of enclosure 37. The cup is designed to be positioned within a conventional cylindrical hole opened through the surface of putting green 10. The enclosure 37 is recessed or buried under the cup 38, which is exposed within the open hole 11.

The lower section of flagstick 36 is coaxially located within cup 38. It can be releasably seated within a recieving socket 39 at the bottom of cup 38 for replacement or repair purposes.

A motor 41 is mounted within the enclosure 37. It is releasably connected to the lower section of flagstick 36 by means of socket 39. Motor 41 is adapted to selectively rotate flagstick 36 about the cup axis.

One end of roller 40 is connected to the lower section of flagstick 36. This connection is preferably a horizontal pinned connection that permits roller 40 to pivot to a limited degree about a horizontal transverse axis across flagstick 36. Such free movement accommodates surface varations in the contour of the green as roller 40 rolls about it.

In practice, manual or automatic controls for roller 40 can be utilized to periodically sweep the area about the open target hole on the putting green 10. FIGS. 2 and 5 illustrate manual push button switches 42 on the tee enclosures, which provide manually operable control means adjacent to the tee and operably connected to the motor 41. The controls associated with switch 42 will normally cause the flagstick 36 to complete one full revolution and to come to rest in alignment with the tee and at the back flagstick (FIG. 7).

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. In a golf layout including a putting green having an open hole recessed therein and a tee spaced from the putting green, the improvement for verifying the occurence of a hole-in-one or other event involving the flight of a golf ball comprising:

a video camera focused on the tee, the putting green, any intervening area between the tee and putting green, and the normal flight trajectory of a golf ball being played from the tee to the putting green;

recording means for storing video images received by the video camera; and coin-operated control means for causing the video camera and recording means to be operational during a predetermined time period after receipt of a specified coin value to provide a stored record of video images showing the tee, the putting green, any intervening area between the tee and putting green, and the complete flight of a golf ball directed from the tee to the putting green during the predetermined time period.

2. The golf layout of claim 1, wherein the video camera is positioned behind the tee.

3. The golf layout of claim 1, wherein the video camera and coin-operated control means are positioned behind the tee in a common enclosure.

4. The golf layout of claim 1, wherein the video camera is positioned beyond the putting green.

5. The golf layout of claim 1, wherein the coin-operated control means is positioned adjacent to the tee and the video camera is positioned beyond the putting green.

6. The golf layout of claim 1, wherein the coin-operated control means is positioned adjacent to the tee, the video camera is positioned beyond the putting green, and the recording means is positioned remotely from both the coin-operated control means and the video camera.

7. The golf layout of claim 1, further comprising:

sweeping means on the putting green for periodically removing golf balls from an area of the green adjacent to the recessed hole.

8. The golf layout of claim 1, further comprising:

a flagstick coaxially located within the open hole and extending vertically upward from it;

motor means operably connected to the flagstick for selectively rotating it about a central vertical flagstick axis; and an extended horizontal roller having a central roller axis, one end of the roller being connected to the flagstick for rotating the roller about the flagstick axis in unison with the flagstick while causing the roller to freely roll about the surface of the putting green adjacent to the open hole.

9. The golf layout of claim 8, wherein the roller has a progressively reduced diameter tapering outward from the flagstick along the roller axis.

10. The golf layout of claim 1, further comprising:

an enclosure having a cylindrical cup formed about a vertical cup axis at the top end of the enclosure, the cup being received within the open hole in the putting green and the enclosure being recessed under the cup;

an axial flagstick, the flagstick being coaxially located within the cup and releasably extending vertically upwardly from it;

a motor mounted within the enclosure, the motor being releasably connected to the flagstick and adapted to selectively rotate it about the cup axis; and an extended horizontal roller having a central roller axis, one end of the roller being connected to the flagstick for rotating the roller about the cup axis in unison with the flagstick while causing the roller to freely roll about the surface of the green adjacent to the open hole.

11. An automated recording system for verifying the occurrence of a hole-in-one or other event involving the flight of a golf ball at a golf layout including a putting green having an open hole recessed therein and a tee spaced from the green, comprising:

a video camera adapted to be focused on a tee, a putting green, any intervening area between the tee and the putting green, and the flight trajectory of a golf ball being played from the tee to the putting green;

recording means for storing video images received by the video camera; and coin-operated control means for causing the video camera and recording means to be operational during a predetermined time period after receipt of a specified coin value to provide a stored record of video images showing the tee, the putting green, any intervening area between the tee and putting green, and the complete flight of a golf ball directed from the tee to the putting green during the predetermined time period.

12. The automated recording system of claim 11, wherein the coin-operated control means is positioned within an above ground enclosure located adjacent to the tee and the video camera is positioned within an above ground enclosure located beyond the putting green.

13. The automated recording system of claim 11, further comprising:

a flagstick coaxially located within the open hole and extending vertically upward from it;

motor means operably connected to the flagstick for selectively rotating it about a central vertical flagstick axis; and an extended horizontal roller having a central roller axis, one end of the roller being connected to the flagstick for rotating the roller about the flagstick axis in unison with the flagstick while causing the roller to freely roll about the surface of the putting green adjacent to the open hole.

14. The automated recording system of claim 13, wherein the roller has a progressively reduced diameter tapering outward from the flagstick along the roller axis.

15. The automated recording system of claim 11, further comprising:

a flagstick coaxially located within the open hole and extending vertically upward from it;

motor means operably connected to the flagstick for selectively rotating it about a central vertical flagstick axis;

an extended horizontal roller having a central roller axis, one end of the roller being connected to the flagstick for rotating the roller about the flagstick axis in unison with the flagstick while causing the roller to freely roll about the surface of the putting green adjacent to the open hole; and manually operable control means located adjacent to the tee and operably connected to the motor means for selectively turning the flagstick about the flagstick axis.

16. A game process for verifying the occurrence of a hole-in-one or other event involving the flight of a golf ball utilizing a golf layout including a putting green having an open hole recessed therein and a tee spaced from the green; a video camera focused on the tee, the putting green, any intervening area between the tee and putting green, and the normal flight trajectory of a golf ball being played from the tee to the putting green; recording means for storing video images received by the video camera; and coin-operated control means for the video camera and recording means; the game process comprising the following steps:

inserting a specified coin value into the coin-operated control means to thereby cause the video camera and recording means to be operational during a predetermined time period;

playing a golf ball from the tee during the predetermined time period; and monitoring the video images stored by the recording means to verify the occurrence of any resulting hole-in-one or other preselected event.

17. A method for recording the occurrence of a hole-in-one or other event involving the flight of a golf ball at a golf layout including a putting green having an open hole recessed therein and a tee spaced from the green, the method comprising the following steps:

focusing a fixed video camera on the tee, putting green, any intervening area between the tee and the putting green, and the flight trajectory of a golf ball when played from the tee to the putting green;

operating the video camera during a predetermined time period after receipt of a specified coin value within a coin-operated control means for the video camera;

playing a golf ball from the tee during the predetermined time period;

recording the video images transmitted by the video camera while it is operational, to thereby store video images showing the tee, the putting green, any intervening area between the tee and putting green, and the flight of a golf ball directed from the tee to the putting green; and monitoring the video images to verify the occurrence of any resulting hole-in-one or other event.

* * * * *